United States Patent [19]

Rainone et al.

[11] Patent Number: 4,726,133

[45] Date of Patent: Feb. 23, 1988

[54] FRAME FOR RELEASABLY FRAMING ARTICLES

[75] Inventors: John P. Rainone, 87-89 Dyke Road, Brighton, East Sussex, England, BN1 3JE; Derek J. C. Bernard, Jersey, Channel Islands

[73] Assignee: John P. Rainone, Sussex, England

[21] Appl. No.: 816,200

[22] Filed: Jan. 6, 1986

[30] Foreign Application Priority Data

| | | | |
|---|---|---|---|
| Jan. 4, 1985 | [GB] | United Kingdom | 8500243 |
| May 10, 1985 | [GB] | United Kingdom | 8511909 |
| Sep. 20, 1985 | [GB] | United Kingdom | 8523324 |

[51] Int. Cl.[4] ..... A47G 1/06

[52] U.S. Cl. ..... 40/155; 40/152.1

[58] Field of Search ..... 40/155, 152.1, 152

[56] References Cited

U.S. PATENT DOCUMENTS

| | | | |
|---|---|---|---|
| 1,893,168 | 1/1933 | Hammer | 40/152.1 |
| 2,540,907 | 2/1951 | Paschal | 40/155 |
| 2,731,748 | 1/1956 | Polay | 40/155 |
| 2,826,843 | 3/1958 | Fabry | 40/152 |
| 2,968,109 | 1/1961 | Timmins | 40/152.1 |
| 3,065,943 | 11/1962 | Hull | 40/155 |
| 3,812,609 | 5/1974 | Volden | 40/155 |
| 4,144,664 | 3/1979 | DeKorte | 40/152.1 |
| 4,271,619 | 6/1981 | Schmidt | 40/155 |
| 4,330,952 | 5/1982 | Swanson | 40/155 |
| 4,462,176 | 7/1984 | Schovee | 40/155 |
| 4,594,802 | 6/1986 | Field | 40/152.1 |

FOREIGN PATENT DOCUMENTS

| | | | |
|---|---|---|---|
| 1974767 | 12/1967 | Fed. Rep. of Germany . | |
| 2759014 | 7/1979 | Fed. Rep. of Germany | 40/152.1 |
| 1212875 | 3/1960 | France | 40/152.1 |
| 490836 | 7/1970 | Switzerland . | |

*Primary Examiner*—Robert P. Swiatek
*Assistant Examiner*—Cary E. Stone
*Attorney, Agent, or Firm*—Burgess, Ryan and Wayne

[57] ABSTRACT

The present invention is directed to a frame (10) for releasably framing articles, such as pictures, photographs, posters and menus. The frame comprises a plurality of elongate members (12, 14, 16, 18) having mitred ends mated together, and a tensible loop (20) wherein the loop is located in a continuous recess (28) formed, on assembly of the frame, by the alignment of sub-recesses (27) located along the length of each member, and wherein the loop is in tension around the frame so as to pull the members together.

26 Claims, 18 Drawing Figures

FIG. 4.
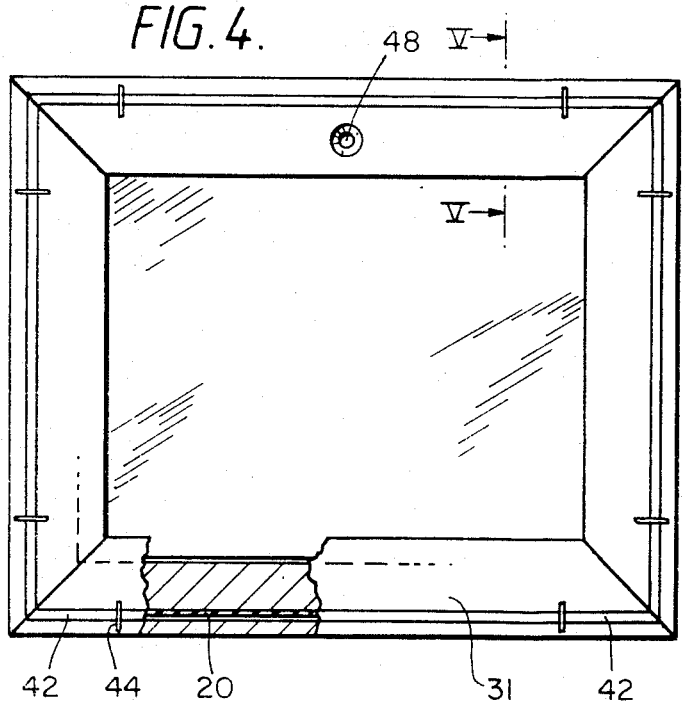
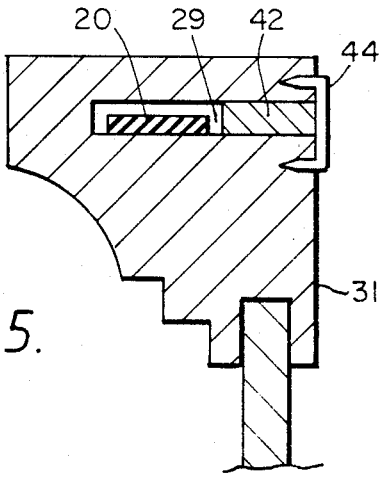
FIG. 5.

FRAME FOR RELEASABLY FRAMING ARTICLES

The present invention relates to a frame for releasably framing articles, such as pictures, photographs, posters and menus.

A conventional frame generally comprises four elongate frame members having mitred ends fastened together at their junctions by means such as pins or adhesive, and which encircle the article to be framed. Once assembled, such a frame is generally permanent which results in the replacement of the articles framed by another being time consuming or in some cases impossible.

Attempts have been made to overcome this problem by making a frame which has more flexibility in use. For instance, G.B. Patent No. 2061108 (Reim) discloses a rectangular frame which comprises L-shaped connecting elements located at each corner, along whose limbs the frame members are slidably received. The frame can therefore be expanded by moving the frame members along the limbs of the elements allowing the framed picture to be taken out and replaced by another.

This arrangement overcomes some of the problems of conventional frames, but is still found to be unsatisfactory. Such a frame is quite complex having eight interengaging elements and is not readily adapted to frame a plurality of pictures or to be used as a frame for articles other than pictures. A further problem with this type of frame, is the need to provide securing means at both ends of each frame member to allow for the sliding fitment of the L-shaped elements. Therefore if the frame members are manufactured by extrusion, the securing means has to be added in an additional stage of manufacture, resulting in increased production costs.

U.S. Pat. No. 3,990,169 (Murray) discloses the use of resilient members located across each corner to urge the frame members into contact with one another. However, it is necessary to provide each fame member with anchoring points so that the resilient members can be attached thereto. Such means complicates the frame members, resulting in the finished frame being prohibitively expensive to produce.

A need therefore arises for a much simplified frame, which is easily manufactured, which allows for the interchange of the articles framed, and which can be assembled quickly without requiring special skills.

According to one aspect of the present invention, there is provided a frame for framing at least one article e.g. a picture, comprising a plurality of frame members arranged in end to end relationship to form the frame and a tensible loop stretched around said frame members to maintain said relationship.

Preferably the loop is disposed in a continuous recess around the frame formed by the alignment of longitudinal sub-recesses in each frame member.

Preferably a sub-groove is provided in an inner surface of each of the members, the sub-grooves aligning to form a continuous groove around the frame's internal perimeter for retaining the at least one article to be framed.

A frame for releasably framing articles is therefore provided which comprises a plurality of frame members which may easily be manufactured by a process such as continuous extrusion from materials such as plastics or metal. A tensible loop is stretched around the members to urge them together. Preferably the loop is an elastic band, these being both cheap and readily available.

The frame of the present invention permits the articles it may frame to be rearranged or replaced. This is achieved by each frame member being flexibly urged into contact with its neighbours by the loop, allowing the picture to be removed from the frame by pulling at least one of the frame members away from the picture against the tension of the loop.

Figure 1:
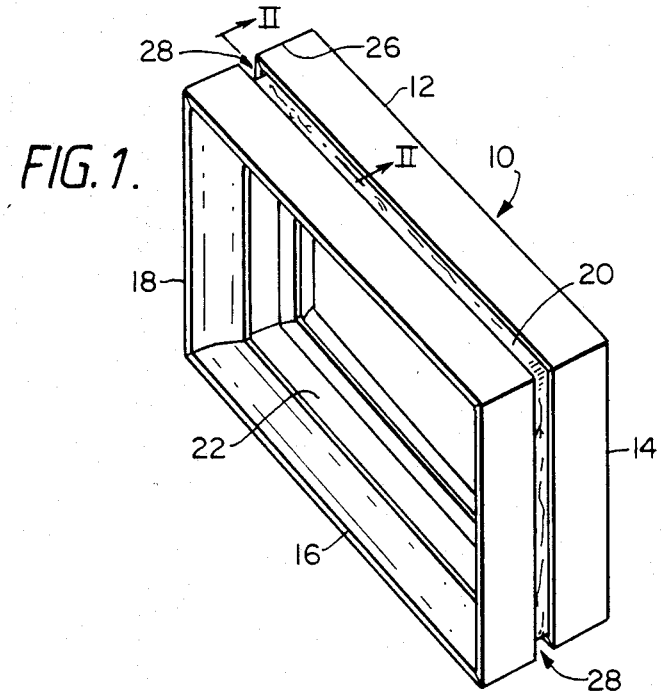
FIG. 1 is a perspective view of a frame according to one embodiment of the present invention.
Figure 2:
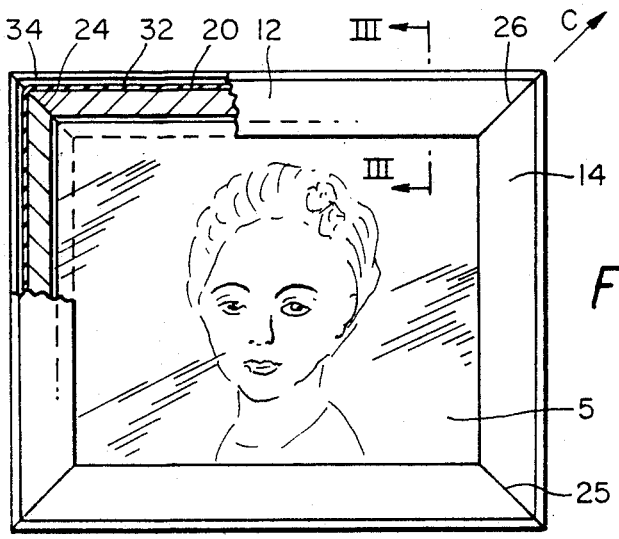
FIG. 2 is a front elevational view of FIG. 1, partly in section along the line II—II of FIG. 1.
Figure 3A:
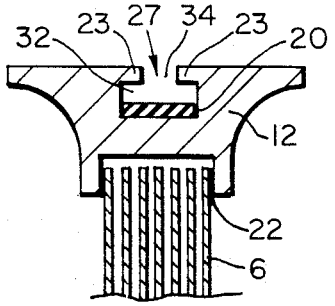
Figure 3B:
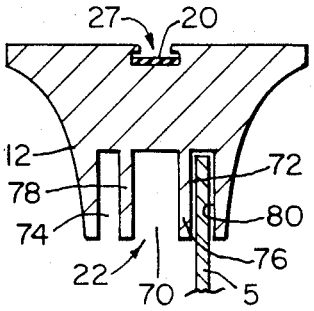
Figure 3C:
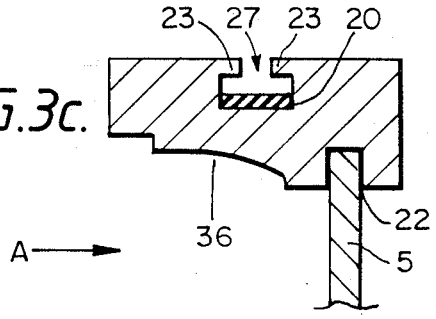
Figure 6:
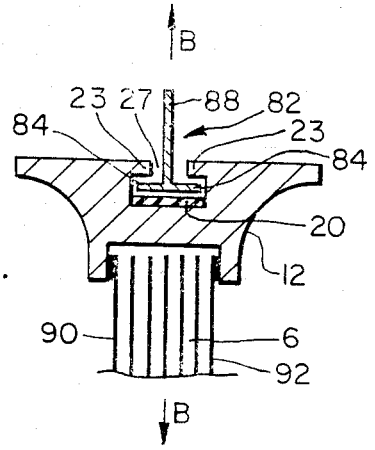
Figure 7:
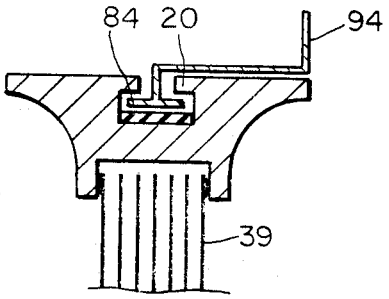
Figure 8:
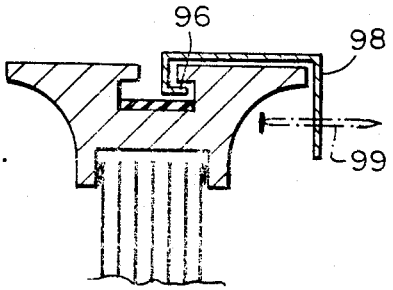
Figure 9:
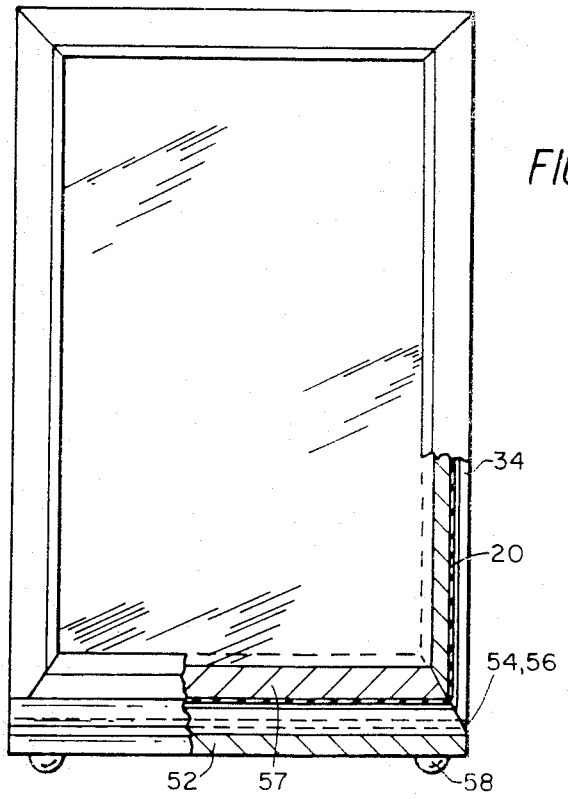
Figure 10:
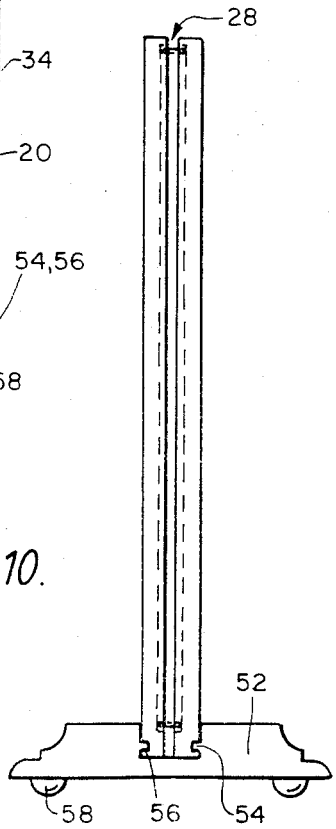
Figure 11:
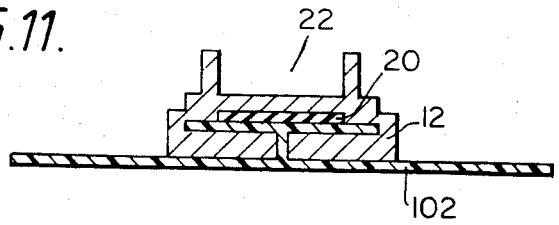
Figure 12:
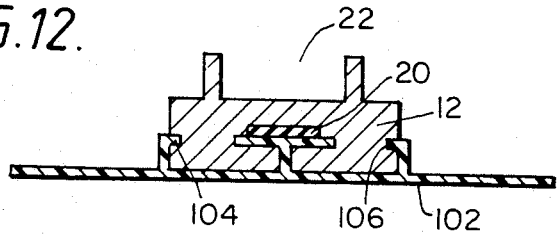
Figure 13:
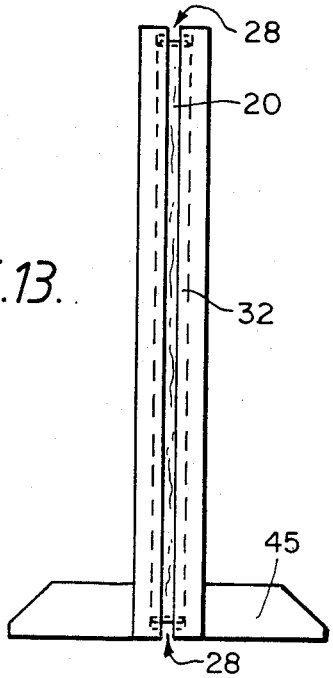
Figure 14:
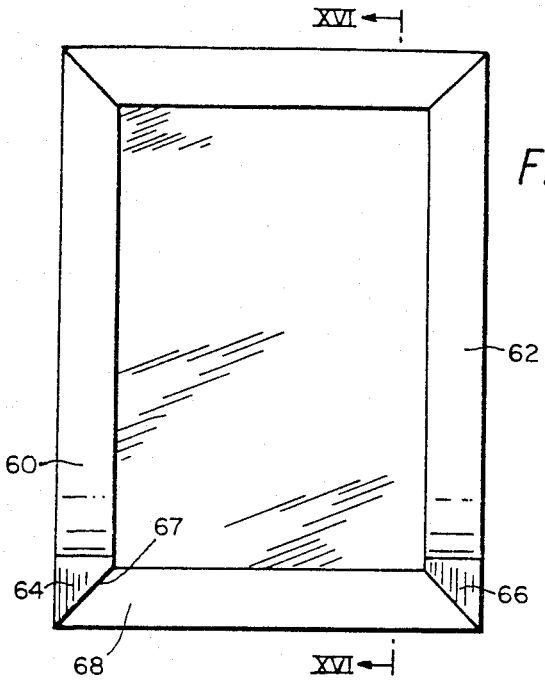
Figure 15:
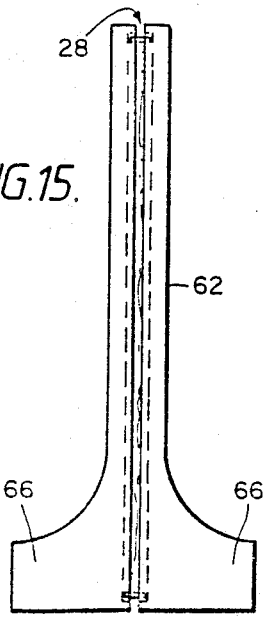
Figure 16:
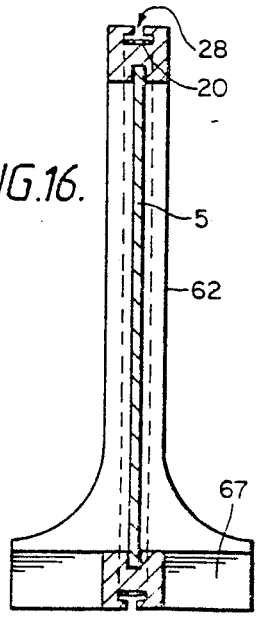

FIGS. 3*a*, 3*b* and 3*c* are cross-sectional views long the line III—III of FIG. 2 illustrating various preferred cross sections of a frame member;

FIG. 4 is rear view, partly in section, of a frame according to a second embodiment of the present invention;

FIG. 5 is a sectional view of a frame member along the line V—V of FIG. 4;

FIGS. 6, 7 and 8 are cross-sectional views illustrating various forms of picture hook which may be attached to the frame;

FIGS. 9 and 10 show front elevational and side elevational views respectively, both partly in section, of a base attached to a frame according to a further embodiment of the present invention;

FIGS. 11 and 12 are cross-sectional views through a frame member illustrating two alternative forms of a base which may be attached to the frame;

FIG. 13 is a side elevational view of a frame including a base according to a further embodiment of the present invention;

FIGS. 14 and 15 show front elevational and side elevational views of a frame of a further embodiment of the present invention; and FIG. 16 is a cross-sectional view taken along the line XVI—XVI of FIG. 14.

Referring now to FIGS. 1–3*c*, a frame according to one embodiment of the present invention is indicated generally at 10 and comprises four frame members 12, 14, 16, 18 arranged to form a frame around which is stretched a tensible loop 20. The frame shown in FIG. 2 holds a picture 5.

Each frame member is provided with a sub-groove 22 on an inner surface. Assembly of the frame members into a frame causes the individual sub-grooves of the members to become aligned to form a continuous groove around the frame's internal perimeter for retaining the articles to be framed. In manufacturing the frame members, the width of their sub-groove may be varied to allow for the framing of a plurality of articles having a relatively small thickness, e.g. photographs.

Each frame member has two mitred ends 24, 26 which are urged into contact with the mitred ends of other members at the corners of the frame. In the present specification, the mitering of the ends of each elongate member is not confined to be at an angle of 45°, but may be varied to any angle suitable to form joints between the various frame members.

Each frame member further includes a continuous sub-recess 27 (FIG. 3*a*) along its outer surface, such that on assembly of the members into a frame, a continuous recess 28 is formed around the external perimeter of the frame. A tensible loop 20 is stretched around the elongate members to urge them into contact with one another at their ends. The loop is of elongate cross-section and each sub-recess 27 has an outwardly facing planar surface to support the inner surface of the loop. This arrangement causes each of the joints of the frame to be flexible, allowing the frame to be easily flexed at each of its corners. For instance, any two adjacent members may be flexed at their junction by as much as 180° with respect to the remaining members of the frame to allow either a picture to be placed in the frame, or pictures already there to be removed or reordered.

The cross-section of the elongate members may vary, e.g., to allow for ornamentation, but it is preferable that it remains constant except for its mitred ends. In this case, the elongate members can each be formed in a single continuous extrusion step from metal or plastics or by a simple continuous machining process from wood strip. Alternatively, each elongate member may be formed in a single step by the injection of plastics material, or by the casting of a suitable metal (e.g. A1) into a suitably shaped mould.

FIG. 3*a* shows a cross-section through a frame member of the present invention in which the sub-groove 22 retains various pictures 6. The frame member is provided with a sub-recess 27, which comprises a wide portion 32 where the loop 20 is located. The loop is confined in the sub-recess 27, by overhanging lip portions 23 which co-operate to form a narrow entrance slot 34, of width less than that of the loop. This results in the loop being somewhat hidden from view and prevents the member 12 from detaching itself from the loop when the elongate members 14 and 18 are pulled in opposite directions.

The frame 10 comprises four straight members and a tensible loop stretched around them. For ease of manufacture it is symmetrical about a central plane through the groove 22. However, as will be clear to those skilled in the art, the frame members may be curved or have bends in them. The frame members may also form a frame other than a rectangular one depending upon the angle at which the ends of the frame members are mitred. Thus a hexagonal frame may be produced if six suitable mitred members are brought together.

If a double sided picture, or stack of superimposed articles having a different picture displayed outwardly on each of its two faces, is placed in the frame according to this embodiment of the present invention, then the frame may be rotated to show different pictures.

In the frame illustrated in FIG. 3*a*, a difficulty arises where the number of articles e.g. photographs is insufficient to fill the continuous groove of the frame compactly. This problem can be overcome by partitioning the sub-groove 22 of the members to allow a single article 5 or possibly a small plurality of articles to be compactly located in a position to be viewed from one side, or preferably both sides of the frame.

Thus in FIG. 3*b*, the original sub-groove indicated at 22 is divided into a central, large sub-groove 70 and two outer relatively narrow sub-grooves 72, 74 by intervening partitions 76, 78. The partitions may be in the form of ridges formed integrally with the frame member. The whole construction of sub-grooves and ridges can be produced in a continuous extrusion step if metal or plastics is used or by a continuous machining step from wood strip. Alternatively a single injection moulding step could be used.

The narrow outer sub-grooves 72, 74 may have a width of e.g. ⅛th inch (3.2 mm). Each partition or ridge 76, 78 may have a width of e.g. 1/16th inch (1.6 mm). It is preferred that the height of each ridge is the same as the height of the inner surface 80 of the frame wall defining the original sub-groove 22. In any case, the height of each ridge should be sufficient to allow for the secure mounting of the article e.g. a photograph, to be framed. The central sub-groove 70 may have a width e.g. of ¼ inch (6.4 mm). Thus if the original sub-groove 22 had an overall width of ½ inch (12.8 mm), this has been extended by ⅛th inch (3.2 mm).

Such a frame may generally be used for displaying photographs. Most modern films give rise to either 12, 24 or 36 photographs. The frame made up of members according to FIG. 3*b* may be used for holding the photographs of any of these types of film, having a capacity of 36 or more photographs. If only 12 photographs are framed, these may still be framed in a 36 photograph frame due to the provision of the partitions. Ten of the photographs are placed in the large sub-groove 70 which may also contain the negatives and the two remaining photographs are placed on display in the outer sub-grooves 72,74.

FIG. 3*c* illustrates a further possible cross section of a frame member forming part of the present invention. The assembly of such members gives rise to a frame having an ornamental appearance, due to the provision of a contoured portion 36. This gives rise to a frame having a decorative appearance when viewed from direction A.

Referring now to FIGS. 4 and 5, a further embodiment of the frame of the present invention is illustrated. FIG. 4 shows a rear view of a frame, partly in section, wherein the loop 20 is located in a sub-recess 29 formed in the rear surface 31 of each of the frame members. On assembly of the frame, these subrecesses align to form a continuous recess which extends around the complete frame. Each sub-recess 29 is then closed, to retain the loop in place, by a fillet 42 which is in turn secured in place by any convenient means e.g. staples 44 or adhesive tape. The frame members making up the frame of this embodiment have a flat rear surface 31 making the frame suitable for wall hanging. Hanging can be accomplished by any known means, e.g. a hole 48 may be drilled part-way through the centre of one member allowing the frame to be hung from a nail extending from a wall. Once the frame is hung, then the loop and fillet are undetectable resulting in what appears to be a standard "permanent type" frame.

A further method of hanging the frame of the present invention is by way of a picture hook. FIGS. 6 to 8 illustrate in cross-section various examples of suitable hooks.

Referring firstly to FIG. 6, a cross-sectional view of a frame member according to one embodiment of the invention is indicated at 12. A loop 20 and a plurality of pictures 6 are also shown.

A picture hook 82 for hanging the frame is shaped in the form of a T and comprises lugs 84 for engaging under the shoulders 23 of the sub-groove 27, and a projecting portion 88 through which a hole is provided for allowing the hook to hang from a nail or the like. The hook 82 can slide along the sub-groove 27 allowing the picture to be correctly balanced to hang straight. The hook can be repositioned in a different frame member by partially disassembling the frame and removing the hook from the sub-groove of one member and replacing it in another. This allows the frame to be interchanged between portrait and landscape orientations.

This picture hook also allows the whole frame to be rotated about the axis B to show either picture 90 or 92.

FIG. 7 illustrates another form of picture hook for use in the present invention. Again, two lugs 84 are provided for engaging in the sub-groove 27 of a frame member. However, the projecting portion 94 is offset to one side of the frame member to allow the frame to more easily hang flush against a wall. If it is required to rotate the frame to show picture 39, then the picture hook is released from the sub-groove by partially disassembling the frame and then replacing it so that projection 94 is adjacent the other side of the frame. The frame is then replaced on the wall to display picture 39.

FIG. 8 illustrates another form of picture hook for use in the present invention. In this embodiment only a single lug 96 is required. The projecting poriton 98 hangs below the frame, and is therefore substantially hidden from view when the frame is in use. Again, to hand the frame, a nail (phantom 99) or similar is positioned through a hole (not illustrated) formed in projection 98.

Turning now to FIGS. 9–16, these illustrate embodiments of the present invention wherein the frame is supported by a base or foot which is formed either integrally or is engageable with the frame. Such a frame may stand freely on any substantially horizontal surface such as a table top or a shelf. This obviates the need for a rudder or strut type support.

FIGS. 9 and 10 illustrate an embodiment of the present invention wherein a base 52 is slidably engaged, via a tongue and groove arrangement 54,56, onto one of the frame members 57. The base may be provided with small feet 58 made e.g. of plastics or rubber at its corners to protect any surface on which the frame is placed from being scratched.

Turning to FIGS. 11 and 12, these show cross-sectional views of a frame member 12 having a base member or foot 102 engaged thereto. In both these embodiments, the sub-recess of frame member 12 includes a secondary recess wherein the loop 20 is located. This allows the base member or foot 102 to engage via a foul contact fitting with the sub-recess of the frame member resulting in a secure fit. This helps prevent any rocking of the completed frame at its junction with the base.

In these two embodiments, the base member or foot and frame members are preferably made of plastics material as these may easily be extruded with the required cross-section. The base member may have a perfectly flat lower surface or it may have its two outer edges turned down such that the frame rests on only these edges.

The frame members produced in accordance with these embodiments are advantageous in that very little material is required as can be seen from the relatively small cross-sectional surface area. Thus frames incorporating such members are relatively cheap to manufacture.

The base 102 may be co-extensive with the frame member to which it is attached, and this results in the frame having excellent stability. Alternately, a relatively shorter base member in the form of small foot may be provided at each end of frame member 12.

In FIG. 12 additional engagement means in the form of a tongue and groove arrangement 104,106 is provided which results in a more extensive engagement between the base member or foot 102 and frame member 12. This embodiment is particularly advantageous in tall free standing frames where rocking at the junction of the base and frame member may otherwise be a problem.

FIG. 13 shows a side elevational view of a frame wherein one member comprises an enlarged outer surface portion 45 which is arranged to constitute a base. The base may be formed along the complete length of the frame member and be of constant cross-section, except for its mitred ends. This allows the member to be manufactured in a single extrusion step. Alternatively the base 45 may comprise tour feet projecting from each side at the ends of the bottom frame member.

FIGS. 14, 15 and 16 illustrate a further embodiment of the invention wherein the two frame members 60, 62 forming the sides of the frame are provided with wings 64, 66 which extend away from the plane of the frame in both directions to form a base. As illustrated in FIGS. 14 and 16, the wings 64, 66 are mitred at their end 67 to form a flush contact with the mitred ends of frame member 68.

The word "loop" as used throughout the specification includes both closed loop structures such as rubber bands or rings and also linear structures whose two ends may be secured together by tying or knotting or by other means e.g. two hooks.

Preferably the loop is an elastic band as these are both cheap and plentiful.

The frame of the present invention has many uses, particularly in situations where it is desirable to interchange the article or articles which are being framed by others.

Thus, if the frame illustrated in FIG. 2 is being used as a photography frame, the frame members 12 and 14 may be pulled in direction C, and flexed around joints 24 and 25 to allow the framed photograph to be removed from groove 22. If a plurality of photographs are within the frame, these may be reordered to move a different photograph to the front of the frame.

One particular application of the frame of the invention is in dispensing photographs produced from a roll of film or a disc. Thus all the photographs developed during the processing of a film might be returned to the photographer placed in the frame to give an inexpensive yet attractive "album".

When changing the picture on view, the frame can be simply rotated through 90° if necessary to follow a change in attitude e.g. from a portrait to a landscape.

Alternativey, if the frame is free-standing on a surface, then a picture may be viewed from either side of the frame, making such a frame "double-sided".

Similarly, the frame might contain a single article having a picture on either side. Thus if the frame is hanging by a hook as illustrated in FIG. 7 or FIG. 8, then the hook only needs to be removed and replaced facing the opposite way and the frame rehung to alter the picture on view.

The frames of the present invention having or joined to bases, find particular use as free-standing display devices, e.g. in restaurants to hold menus particularly as these are generally changed each day. It will be noted that frames such as that shown in FIG. 6 can be viewed from either side, thus allowing both sides of a menu to be viewed simultaneously.

Because of the simplicity of construction of the present frame, they may be easily constructed from kits. A suitable kit comprises two frame members of a given length and an elastic band. In the case where a rectangular article of known size is to be framed, the purchaser has only to buy two kits each comprising the two opposite sides of the frame and an elastic band, and assemble them.

The frame of the present invention is not restricted to the framing of rectangular articles, and any suitably shaped article e.g. of hexagonal outline may have a frame constructed for it.

The frame members of the present invention can be constructed from wood e.g. by machining, or may be manufactured by an extrusion process from plastics or metal.

While more generally useful for framing planar articles, the present frame can be used for other purposes. For instance, it may be used as the framework for a toilet roll holder e.g. having an axle held between two opposite frame members. Thus when the roll is expired, the frame can be pulled apart, the empty roll removed from the axle, a fresh roll slipped over the axle, and the frame reassembled.

We claim:

1. A frame for framing at least one article, comprising a plurality of separate frame members arranged in end to end relationship to form the frame and means for maintaining all ends of said frame members in abutting relationship, said means consisting solely of an elastic band stretched around said frame members to maintain said relationship.

2. A frame according to claim 1 wherein the elastic band is disposed in a continuous recess around the frame formed by the alignment of longitudinal sub-recesses in each frame member.

3. A frame according to claim 2 wherein the elastic band is of elongate cross-section and each sub-recess has an outwardly facing planar surface to support the inner surface of the band.

4. A frame according to claim 2 wherein the sub-recesses are formed in the outer surface of each of the frame members.

5. A frame according to claim 4 wherein the sub-recesses comprise a wide portion where the elastic band is located and an entrance slot whose width is smaller than the width of the elastic band.

6. A frame according to claim 2 wherein the sub-recesses are formed on a rear surface of each of the members.

7. A frame according to claim 6 wherein a fillet is inserted into each sub-recess to retain the elastic band within the sub-recess.

8. A frame according to claim 2 further comprising at least one base member engageable in the sub-recess provided on a frame member.

9. A frame according to claim 2 further comprising a hook for hanging the frame which engages in the sub-recess of a member.

10. A frame according to claim 1 wherein each frame member is straight and has both its ends mitred.

11. A frame according to claim 10 wherein each frame member is, except for its mitred ends, of identical cross-section.

12. A frame according to claim 11 which is substantially symmetrical in the plane of the frame.

13. A frame according to claim 1 wherein a sub-groove is provided in an inner surface of each of the frame members, the individual sub-grooves of each of the frame members aligning to form a continuous groove around the internal perimeter of the frame for retaining the at least one article.

14. A frame according to claim 13 wherein the continuous groove is of sufficient width to frame a plurality of superimposed articles.

15. A frame according to claim 13 wherein each sub-groove is divided by at least one partition into a large sub-groove and a relatively narrow sub-groove.

16. A frame according to claim 1 wherein the loop is a rubber band.

17. A frame according to Claim 1, wherein the frame members are made from a material in the group consisting of extruded plastics, metal and wood.

18. A frame according to claim 1 further comprising at least one base member engageable with means provided on a frame member.

19. A frame according to claim 18 wherein the base member slidably engages with the frame member via a tongue and groove arrangement.

20. A frame according to claim 1 wherein one member comprises at least one enlarged outer surface portion arranged to constitute a base.

21. A frame according to claim 1 having four members adapted to frame at least one rectangular article.

22. A frame according to claim 21 comprising two members of a first length and two members of a second length.

23. A frame according to claim 21 wherein two of said frame members form sides of the frame, and said sides include wings extending away from the central plane of the frame for forming a base.

24. A frame according to claim 1 wherein the frame members are in contact in said end to end relationship.

25. A frame for framing at least one article, comprising a plurality of separate frame members arranged in end to end relationship to form the frame, and an elastic band stretched around said frame members, all ends of said frame members being held in contact with one another in framing relationship solely by the elastic band to maintain said relationship.

26. A kit of parts for use in the assembly of a frame for framing at least one article, comprising:

four separate frame members adapted to be arranged in end to end relationship to form the frame about at least one rectangular article, two of said members having a first length and the other two of said members having a second length; and means for maintaining all ends of said frame members in abutting relationship, said means consisting solely of an elastic band adapted to be stretched around said frame members to maintain said relationship.

* * * * *